US006058613A

United States Patent [19]

So

[11] Patent Number: 6,058,613

[45] Date of Patent: May 9, 2000

[54] CAN OPENER

[76] Inventor: Shun So, 2/F., Chuan Yuan Factory Building, 342-344 Kwun Tong Road, Kwun Tong, Kowloon, The Hong Kong Special Administrative Region of the People's Republic of China

[21] Appl. No.: 09/184,179

[22] Filed: Nov. 2, 1998

[30] Foreign Application Priority Data

Mar. 6, 1998 [GB] United Kingdom ..... 9804888
Sep. 9, 1998 [GB] United Kingdom ..... 9819656

[51] Int. Cl.[7] ..... B67B 7/46

[52] U.S. Cl. ..... 30/418; 30/422

[58] Field of Search ..... 30/410, 417, 418, 30/422, 425, 434, 440, 441

[56] References Cited

U.S. PATENT DOCUMENTS 3,659,341 5/1972 Kappler ..... 30/410 X
4,782,594 11/1988 Porucznik et al. ..... 30/418 X
5,787,592 8/1998 Lai ..... 30/418

FOREIGN PATENT DOCUMENTS

W085/03280 8/1985 WIPO .
W090/05108 5/1990 WIPO .

*Primary Examiner*—Douglas D. Watts
*Attorney, Agent, or Firm*—Darby & Darby

[57] ABSTRACT

A manually operable can opener of the rim-cutting type comprises a rotatable traction wheel (22) of generally cylindrical configuration and a freely rotatable circular cutter blade (48) wherein the rotational axis of the cutter blade is inclined to the rotational axis of the wheel at an angle of substantially 6°. In their operative position, the cutter blade (48) penetrates a radially outer thickness of metal material comprising the rim but does not cut completely through the rim whereby the can end (62) may be cut leaving a smooth edge both to the end (62) and the side wall (68) of the can. Complete separation of the cut end from the can body is facilitated by gripper jaws (70, 72) movable by the user to grip that part of the rim attached to the can end to hold and detach it from the remainder of the rim attached to the can body.

18 Claims, 9 Drawing Sheets

CAN OPENER

This invention relates to a can opener, which may be of a manually operable type, having a rotatable circular traction wheel and a rotatable circular cutter blade for engagement with a metal can for removing an end therefrom.

Manually operable can openers have been known for many years and may be broadly categorised into three types: a first type having a cutter blade which cuts directly into an end of the can, a second type having a cutter blade which cuts into the side wall of the can below the rim, and a third type having a cutter blade which cuts into the rim of the can.

Can openers of the first type have a cutter blade whose axis of rotation is inclined to the axis of rotation of the traction wheel. In this type of can opener, the blade and the wheel are each usually provided with a circular gear whereby in the operative condition of the opener, the gear wheels are in mesh with one another whereby rotation of the wheel by the user in one direction rotates the cutter blade in the opposite direction. In use, the traction wheel engages the rim of a can at the under surface of the rim with the wheel substantially parallel to the longitudinal axis of the can. The cutter blade penetrates completely through and cuts the end of the can at a position slightly radially inwards of the can rim whereby the end is removable upon a complete revolution of the can about its longitudinal axis relative to the opener. Disadvantages of this type of can opener are that metal cuttings and/or other contaminants on the outer surface of the can end may fall into the can during opening. After removal of the can end, sharp edges are present on the can at the radially inner surface of the rim and on the removed can end.

Can openers of the second type have a traction wheel and cutter blade whose axes of rotation are substantially parallel to one another and wherein the wheel and the blade overlie one another to some extent when the opener is in its operative condition. The traction wheel is rotatable by the user and the cutter blade is freely rotatable. In use, the wheel engages the radially inner surface of the can rim with its axis of rotation parallel to the longitudinal axis of the can. The cutter blade penetrates completely through and cuts the side wall of the can slightly below the under surface of the rim whereby the can end and the can rim are removable together upon a complete revolution of the can about its longitudinal axis relative to the opener. Disadvantages of this type of can opener are that metal cuttings can enter the can during opening. After removal of the can end and rim, sharp edges are present on the upper edges of the can side wall. Also, at the time of final separation of the end and rim from the can body, the body may fall and spill its contents if it is not firmly supported by the user.

Can openers of the third type have a cutter blade so disposed relative to the traction wheel that in use, the cutter blade cuts into but not completely through the rim of the can adjacent an end thereof. Cans are generally formed from a cylindrical metal body and two separate metal end caps wherein each end of the body and the outer edge of a respective end cap are folded together to form a sealed closure rim. The rim usually comprises five thicknesses of metal when viewed in cross section being a radially inner, a radially outer and a central thickness of end cap metal, and two intermediate thicknesses of body metal each sandwiched between two of the thicknesses of end cap metal. A can opener with a rim-cutting mechanism of this type is intended in use to cut through the radially outer thickness of metal comprising the rim whereby the remainder of the end becomes releasable from the remainder of the can body leaving a part of the rim in situ on the end and another part of the rim in situ on the body.

In practice, the end of the can with the part of the rim attached thereto does not always separate readily from the remainder of the rim attached to the can body. This lack of ready separation may be due to variations in the thickness of metal and size of rim as between one can and another whereby the outer thickness of metal comprising the rim is not completely severed from the remainder. Also, some constructions of can rim utilise a gum between the thicknesses of metal to seal the rim against contamination from the atmosphere as a result of which, even if the outer thickness of the rim is completely severed, it may not separate readily from the remainder.

It has been proposed to utilise a device attached to a can opener for assisting the removal of the end from a can after the outer thickness of the rim has been cut. For example, International Patent Publications WO 85/03280 and WO 90/05108 both disclose a mechanism comprising a pivotal arm with an integral claw resiliently biased towards an abutment on the opener whereby the claw is intended to engage in the cut formed in the outer thickness of metal of the rim. After such engagement, it is intended that the can opener should be pivoted so that upward pressure may be applied by the claw to the undersurface of the cut rim to lever the rim and can end away from the remainder of the rim attached to the can body thereby completely to separate the can end from the can body. A disadvantage of both the above mechanisms is that after separation from the can body, the can end with its attached part of the rim may not be readily disengageable from the claw mechanism. For example, if the rim is radially thicker than average it may become jammed between the claw and the abutment. It is then necessary for the user manually to release the rim from the claw with the attendant risk of hand injury and unhygienic contact with the undersurface of the can end.

It is an object of the present invention to provide a new and improved can opener of the type having a cutter blade engageable with the rim of a can.

In accordance with the invention there is provided a can opener comprising a pair of operating elements pivotal with respect to one another, one said element mounting a rotatable traction wheel and the other said element mounting a rotatable circular cutter blade, said wheel and said blade being moveable between an inoperative position in which said wheel and said blade are spaced from one another to an extent that the rim of a can to be opened is locatable between said wheel and said blade, and an operative position in which said wheel and said blade are in close proximity and engageable with a said can to effect opening thereof characterised in that the traction wheel is of generally cylindrical configuration and has an axis of rotation which in use is substantially parallel to the longitudinal axis of a can to be opened, and the cutter blade has an axis of rotation inclined at an angle of substantially 6° to the axis of rotation of the traction wheel, said wheel and said blade in said operative position being in opposed non-overlapping relationship with one another and spaced apart at their nearest points by a distance less than the thickness of the rim of a can to be opened whereby, in use in said operative position, said wheel is engageable with the radially inner surface of a said can rim in parallel or substantially parallel relationship with an end of the can and said blade is engageable with the radially outer surface of a said can rim to penetrate said rim partially but not completely, rotation of said wheel effecting cutting of said rim by said blade, the penetration of the cut being sufficient to sever a said end from the can.

Preferably there is provided abutment means on the can opener for engagement with the axially outer end of the rim in said operative position thereby in use to enhance maintenance of the orientation of the traction wheel and cutter blade relative to the can. Conveniently said abutment means comprises a pair of spaced apart shoulders which in use abut the axially outer end of the can rim at circumferentially spaced apart positions therealong.

The inclination of the axis of rotation of said cutter blade to the axis of rotation of said wheel causes a force to be applied to a can rim tending to urge the can axially in a direction to maintain the rim between said wheel and said blade during rotation of the blade and wheel relative to one another. Preferably said wheel has a serrated surface to enhance the force applied to a can rim to maintain it between said wheel and said blade.

The one operating element which mounts said traction wheel conveniently comprises a planar face and the axis of rotation of said wheel is perpendicular to said face, and the other operating element which mounts said cutter blade comprises a planar face parallel to the planar face of the other operating element whereby, in use in said operative position, said planar faces are parallel or substantially parallel to an end of a can to be opened. Conveniently the said abutment means comprise a pair of spaced apart shoulders on that operating element which mounts the traction wheel.

Conveniently said wheel is mounted for rotation on an axle member and is driveable for rotation by a drive member mounted on said axle, said drive member comprising a manually operable handle. Conveniently said cutter blade is mounted on an axle member and is freely rotatable relative to its associated operating element.

Said cutter blade may be part of an assembly comprising the said cutter blade and a circular friction wheel rotatable about the same axis of rotation as the cutter blade, said friction wheel being located axially outwardly of said cutter blade relative to the operating element on which they are mounted and being of such a diameter that, in use in said operative position, said friction wheel is engageable with the side wall of a can to be opened below the rim thereof.

Said operating elements are preferably of elongate configuration pivotally connected together and providing handle portions at adjacent ends of said elements for grasping by a user, respective other ends of said elements mounting said traction wheel and said cutter blade.

Said operating elements may includes stop means limiting their relative pivotal movement between said inoperative and operative positions of said traction wheel and cutter blade.

Preferably said wheel and said cutter blade are mounted on said operating elements at respective opposite ends thereof to said handle portions, and said operating elements are pivotally connected together intermediate their ends.

Also in accordance with the invention there is provided a can opener comprising a pair of operating elements pivotal with respect to one another, one said element mounting a rotatable traction wheel and the other said element mounting a rotatable circular cutter blade, said wheel and said blade being moveable between an inoperative position in which said wheel and said blade are spaced from one another to an extent that the rim of a can to be opened is locatable between said wheel and said blade, and an operative position in which said wheel and said blade are in close proximity and engageable with a said can to effect opening thereof; said wheel and said blade in said operative position being in opposed non-overlapping relationship with one another and spaced apart at their nearest points by a distance less than the thickness of the rim of a can to be opened whereby, in use in said operative position, said wheel is engageable with the radially inner surface of a said can rim and said blade is engageable with the radially outer surface of a said can rim to penetrate said rim partially but not completely, rotation of said wheel effecting orbiting of said blade about said rim thereby cutting said rim by said blade; and a device for assisting removal of the can end and that part of the rim attached thereto from the remainder of the rim attached to the can body after cutting of the rim;

characterised in that said device comprises a first gripper member mounted on one of said operating elements and a second cooperating gripper member mounted on the other said operating element, the gripper members being moveable towards and away from one another upon pivotal movement of the operating elements relative to one another, whereby the gripper members may be brought towards one another by the user to grip that part of the rim attached to the can end thereby to enable the user to remove the can end and its attached said part of the rim from the remainder of the rim attached to the can body and whereby the gripper members may be moved away from one another by the user to release said part of the rim.

One said gripper member may comprise a gripper jaw fixedly secured to one of the operating elements and the other said gripper member may comprise a gripper jaw integral with the other operating element.

Conveniently the one said gripper jaw is fixedly secured to that operating element which mounts the traction wheel and the other said gripper jaw is integral with that operating element which mounts the cutter blade.

Conveniently the said gripper members are separated from one another in the said inoperative position and are moveable towards one another as the operating elements are moved towards said operative position.

Each said gripper member conveniently comprises a serrated gripper face, the two said faces being opposed to one another, thereby to enhance the grip of the gripper members, in use, on a said part of the rim.

Preferably the opposed gripper faces of the gripper members are disposed substantially parallel to one another in the said operative position.

Other features of the invention will become apparent from the following description given herein solely by way of example with reference to the accompanying drawings wherein.

Figure 10:
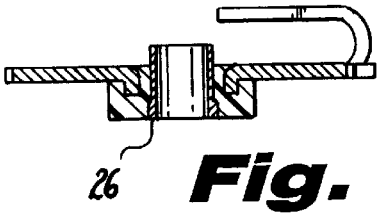
Figure 4:
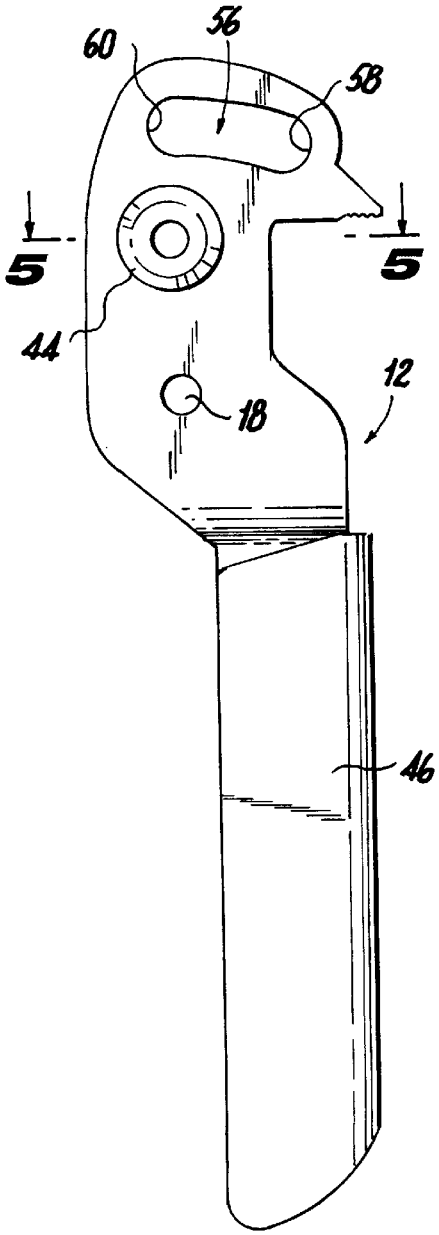
FIG. 4 is an underneath plan view of that operating element which mounts the cutter blade thereon.
Figure 9:
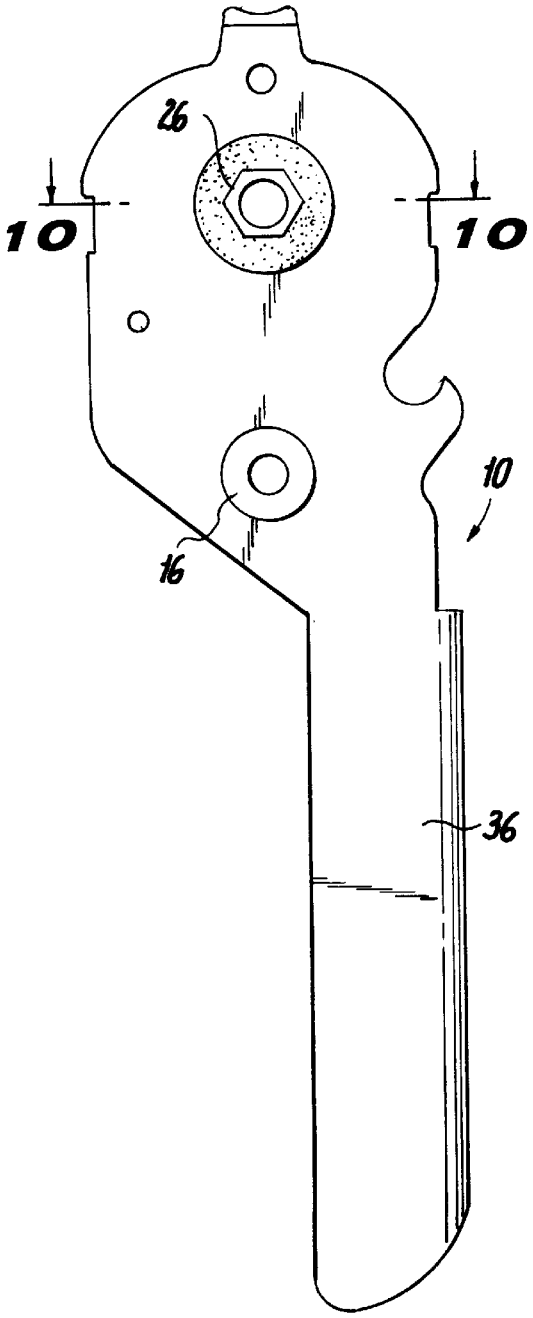
Figure 7A:
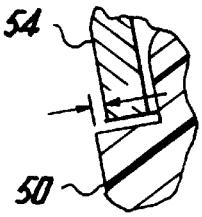
FIG. 7 is a cross-sectional view of the cutter blade and operating element of FIG. 6 and showing an enlarged detail.
Figure 7:
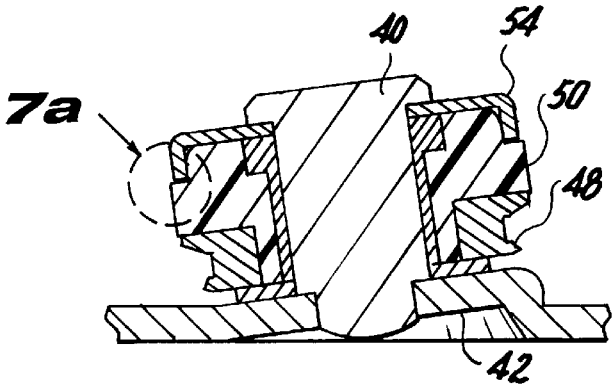
Figure 8:
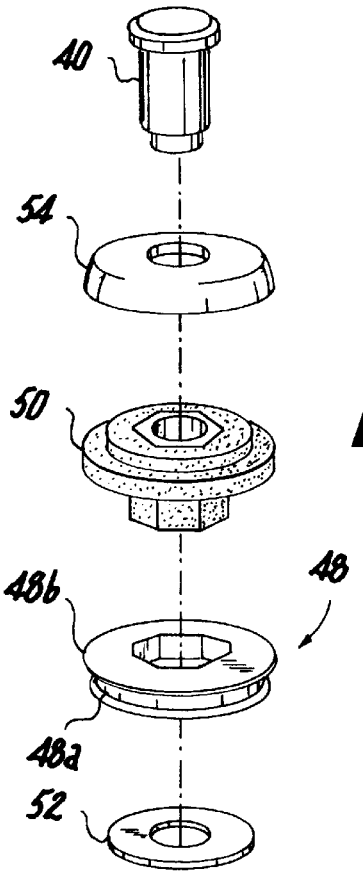
Figure 11:
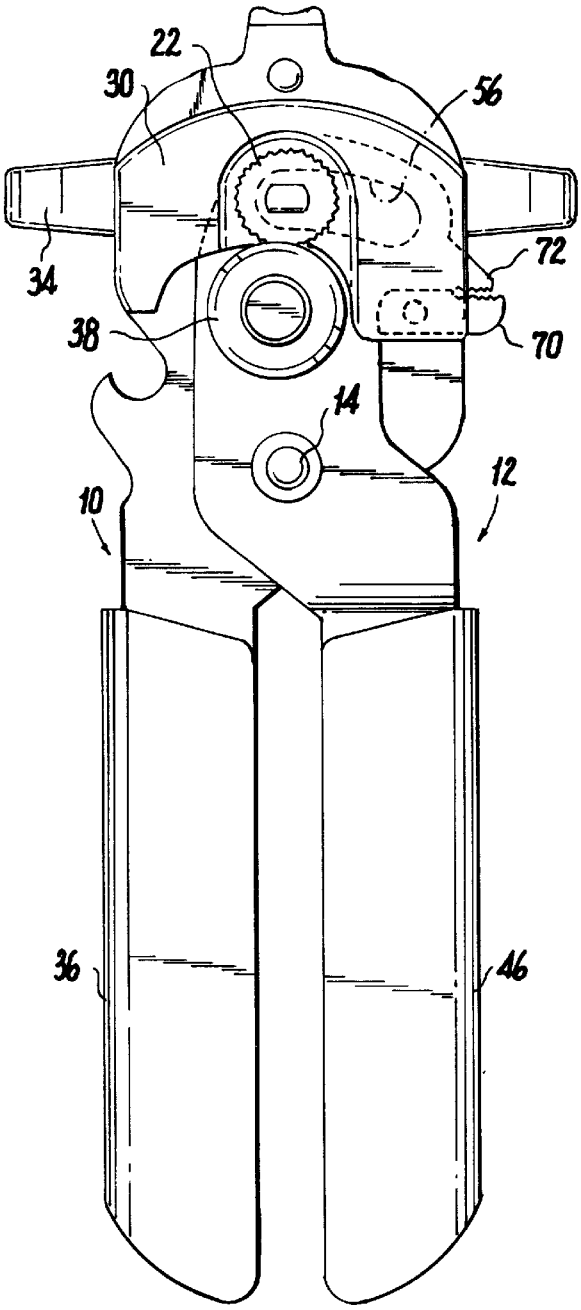
Figure 12:
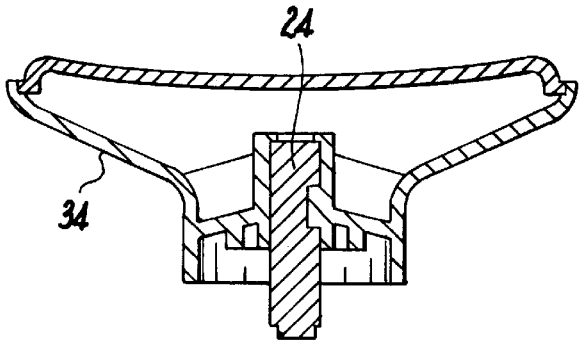
Figure 13:
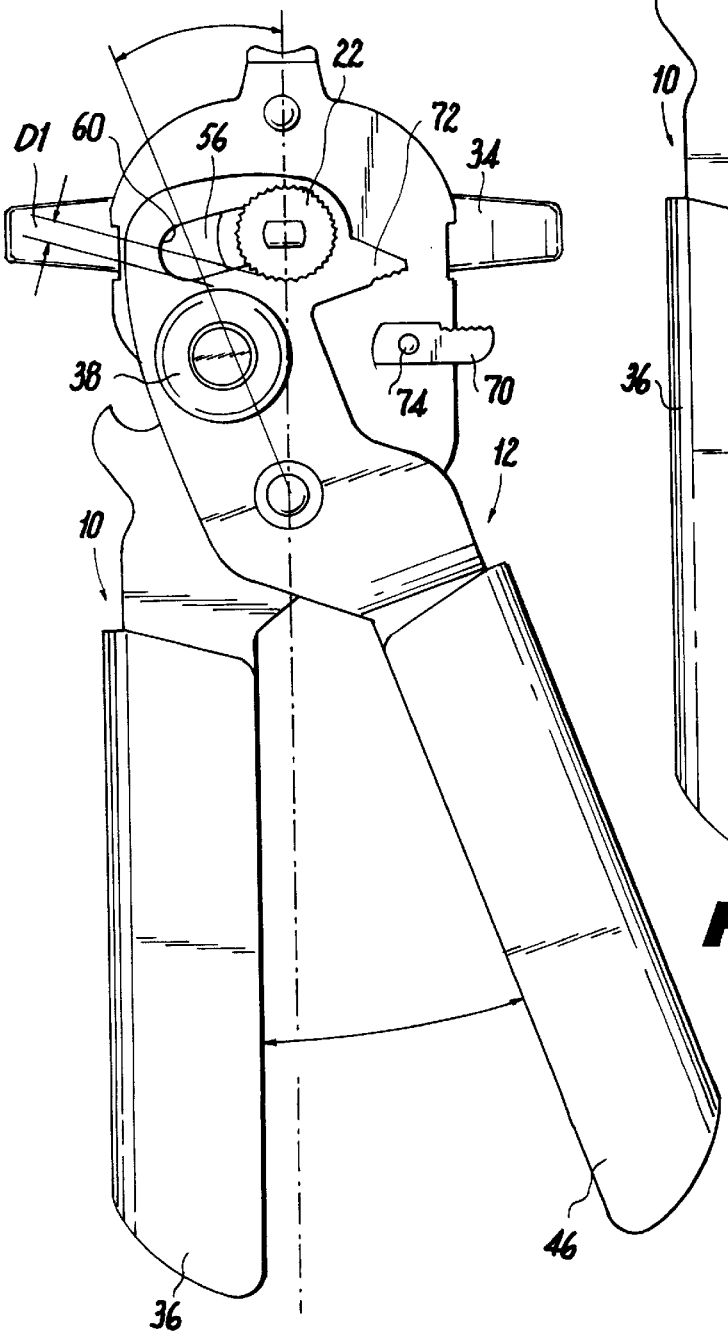
Figure 14:
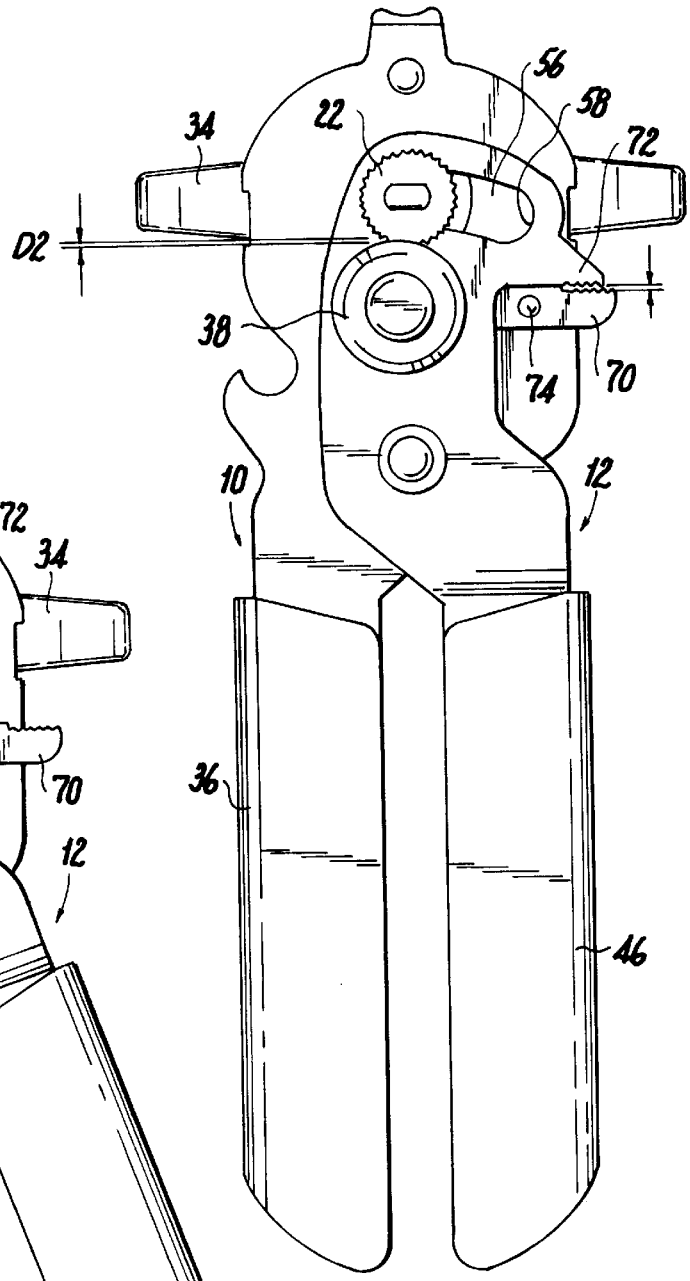
Figure 15:
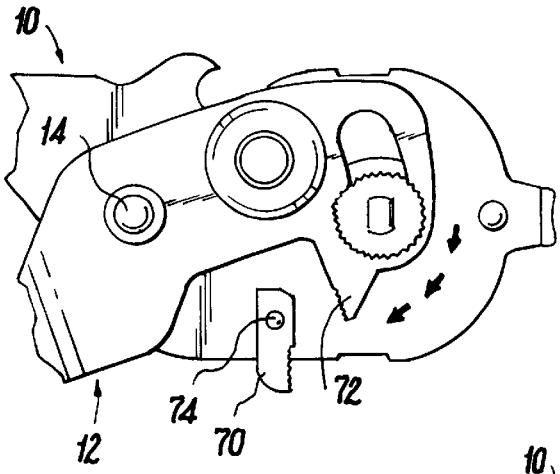
Figure 16:
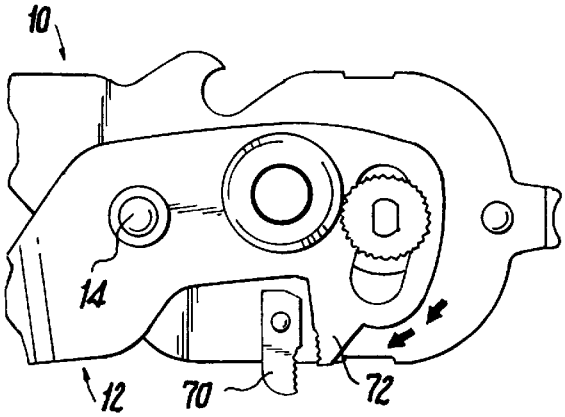
Figure 17:
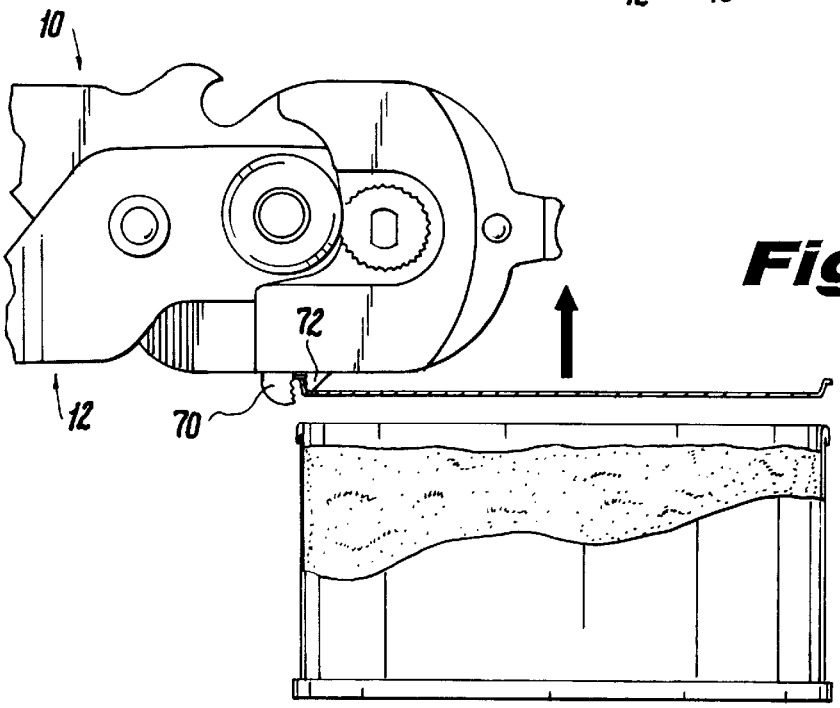
Figure 18:
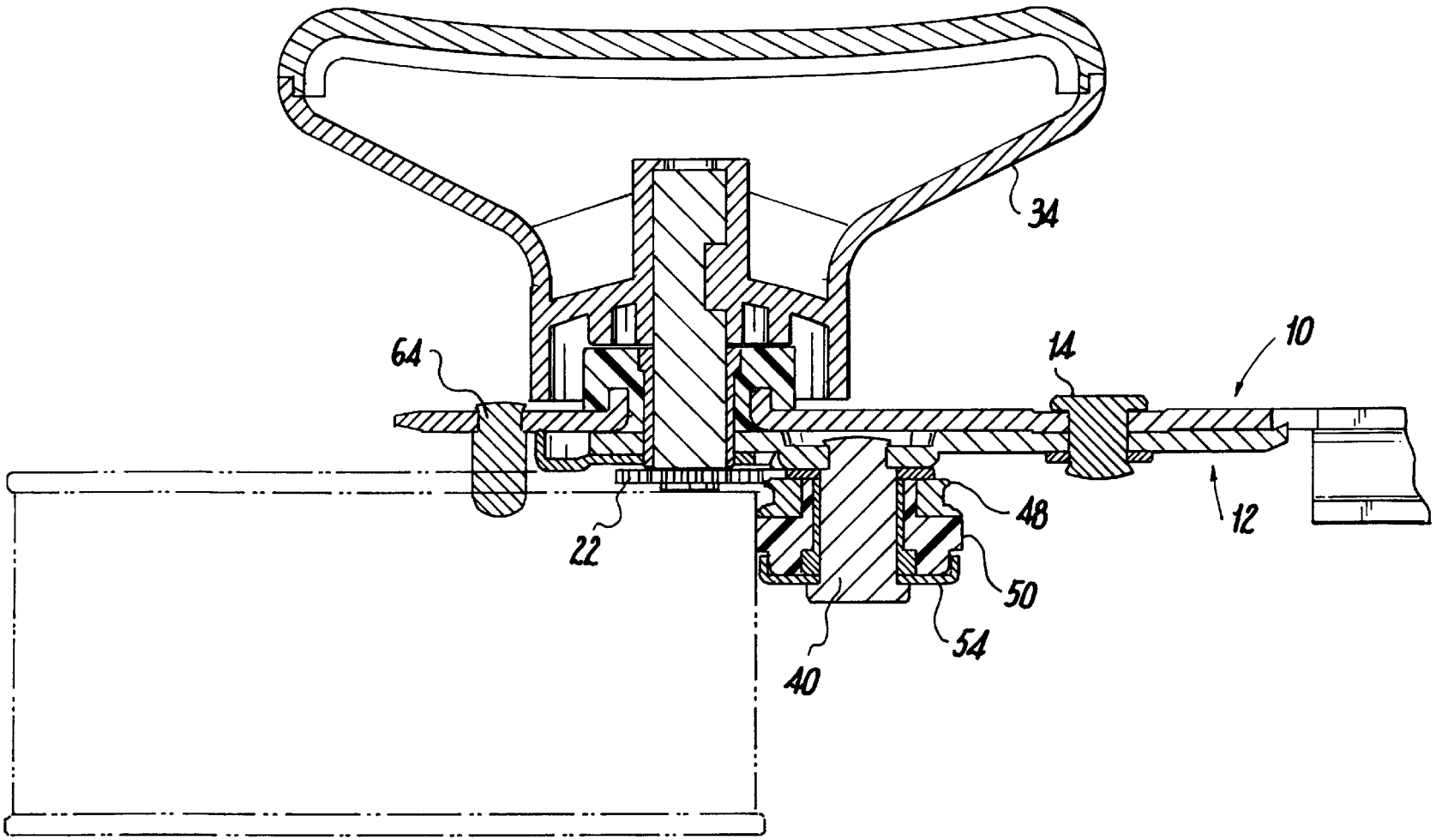
Figure 19:
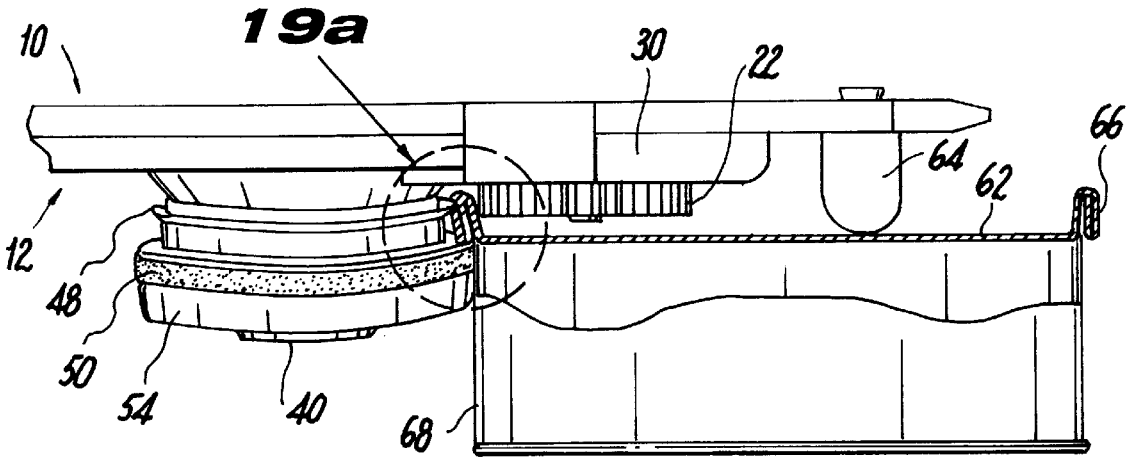
Figure 19A:
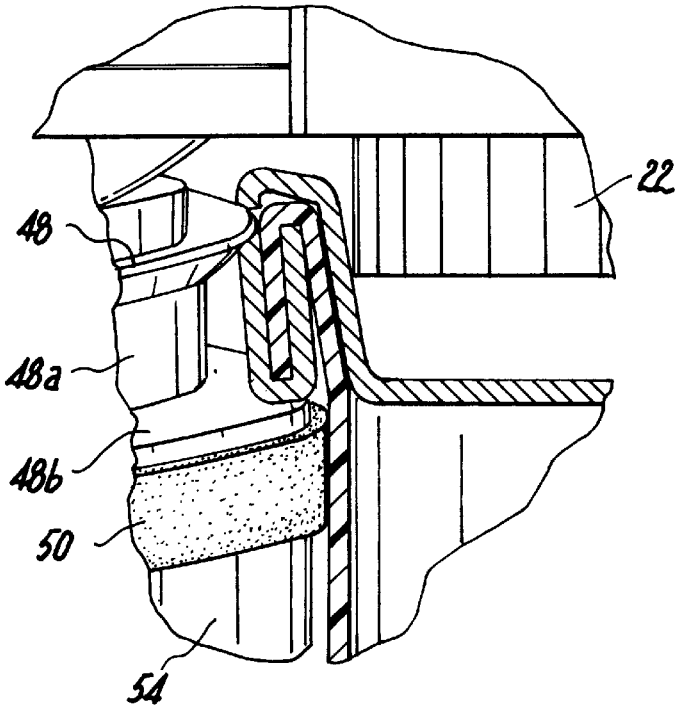

FIG. 7*a* is a detail view of the circled portion of FIG. 7;

FIG. 8 is an exploded perspective view of the cutter blade assembly;

FIG. 9 is an underneath plan view of that operating element which mounts the traction wheel thereon;

FIG. 10 is a cross-sectional view on the line B—B of FIG. 9;

FIG. 11 is a bottom plan view of the can opener with the traction wheel and cutter blade in their said operative position showing a cover plate with abutment shoulders overlying that end of the operating element mounting the cutter blade, said end of said element being shown in dotted outline;

FIG. 12 is a cross-sectional view of the operating handle;

FIG. 13 is a bottom plan view of the can opener with the traction wheel and cutter blade in their said inoperative position with the cover plate and handle covers removed;

FIG. 14 is a similar bottom plan view to that of FIG. 14 but with the traction wheel and cutter blade in their said operative position;

FIG. 15 is a detail underneath plan view of the can opener showing the gripper members separated from one another;

FIG. 16 is a similar view to that of FIG. 15 showing the gripper members moved towards one another;

FIG. 17 is a further similar view showing the gripper members engaged about a part of a rim attached to a can end after separation from the remainder of the can;

FIG. 18 is a side elevation partly in cross section showing the can opener in use with the wheel and the cutter blade in their operative position engaged with respective opposite sides of a can rim;

FIG. 19 is a side elevation similar to that of FIG. 18 with an enlarged detail showing the engagement of the traction wheel and cutter blade with the can rim; and FIG. 19*a* is a detail view of the circled portion of FIG. 19.

Figure 1:
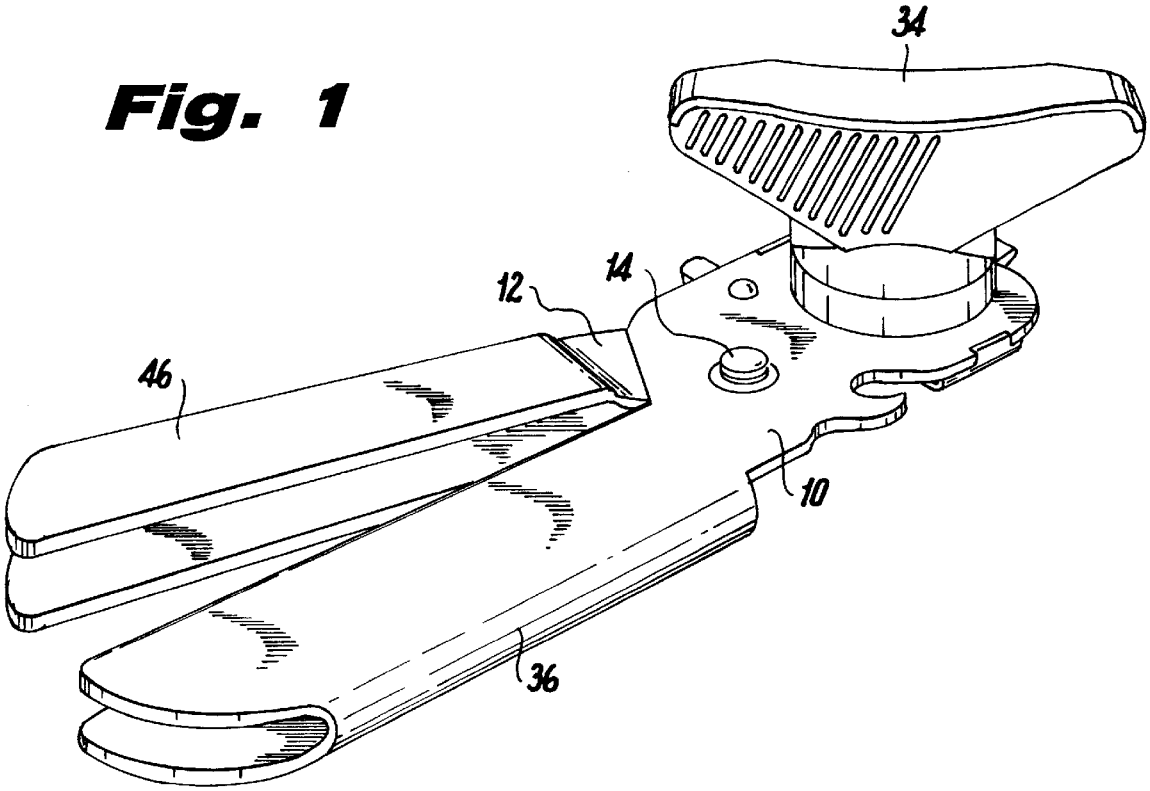
FIG. 1 is a top perspective view of a can opener constructed in accordance with the invention with the traction wheel and cutter blade in their said inoperative position.
Figure 2:
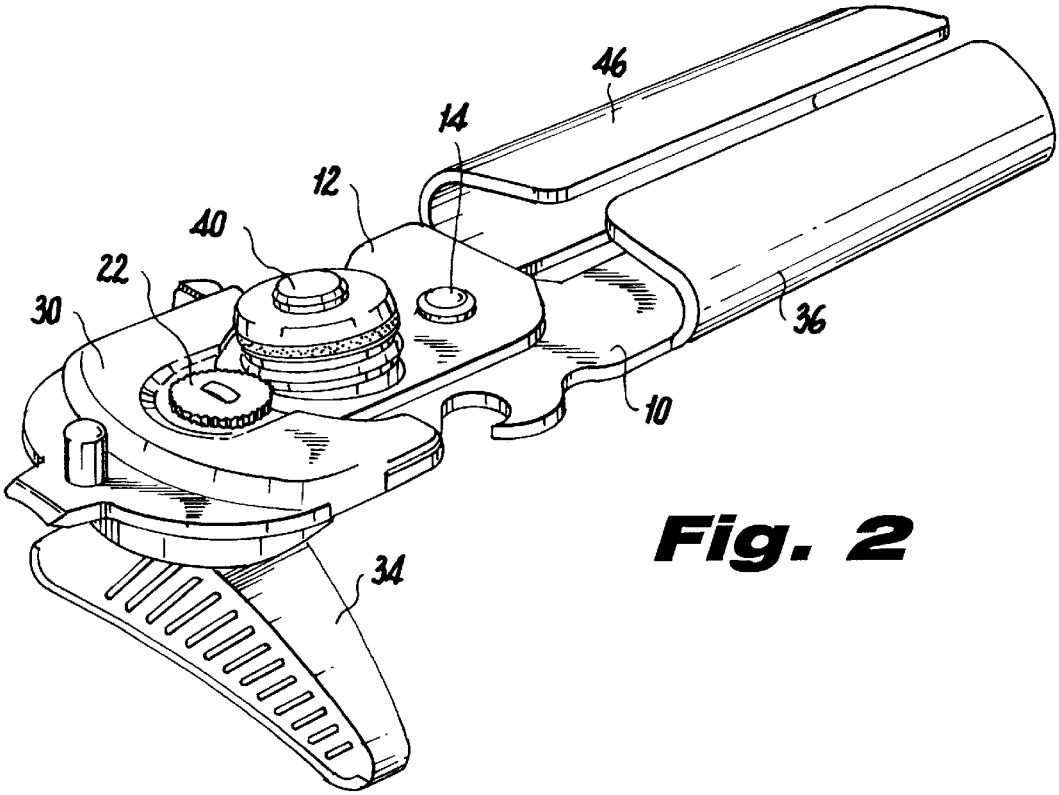
FIG. 2 is an underneath perspective view of the can opener of FIG. 1 with the wheel and cutter blade in their said operative position.
Figure 3:
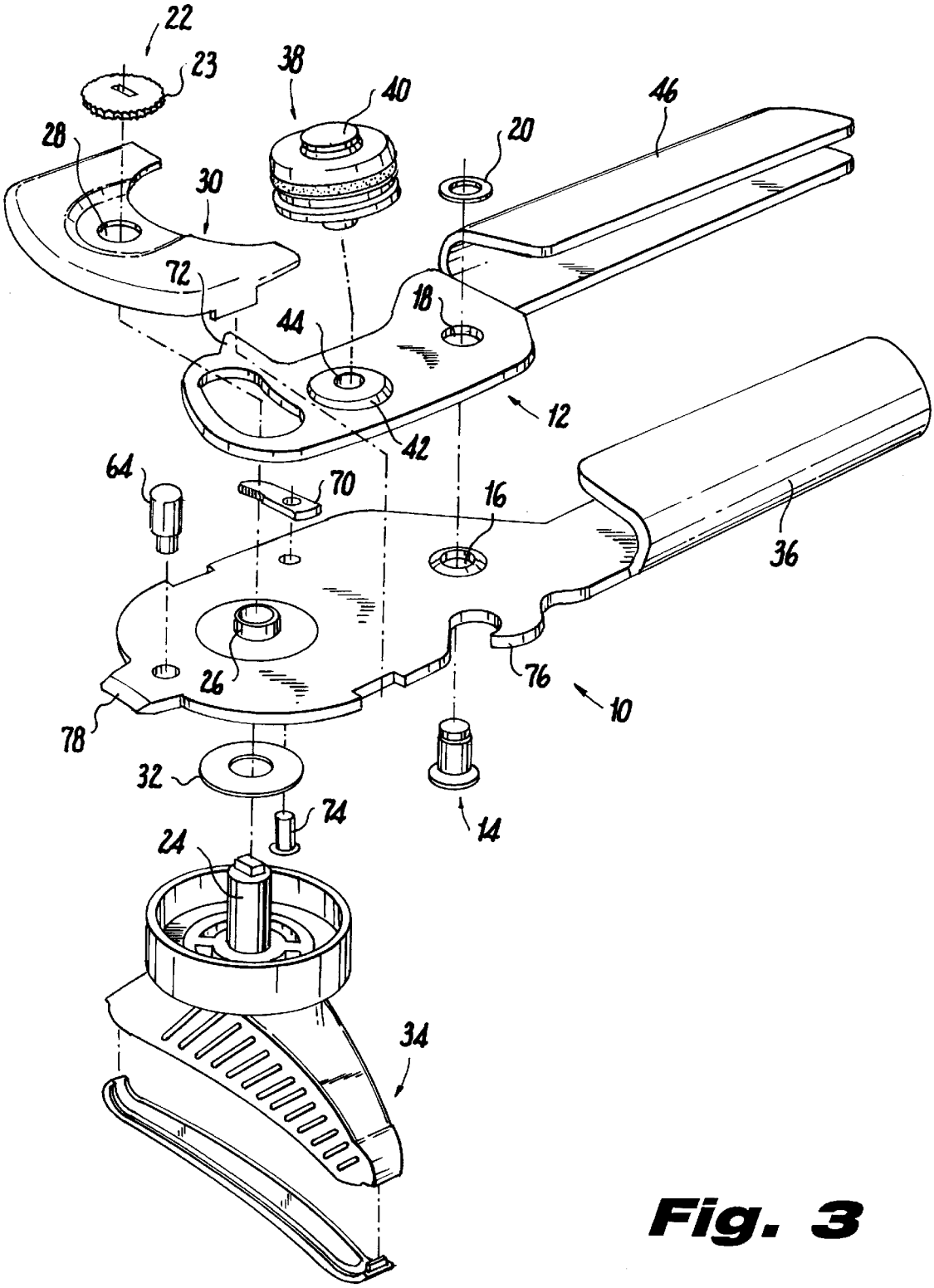
FIG. 3 is an exploded perspective view of the structural elements of the can opener of the invention.

The construction of the can opener illustrated herein by way of example will now be described initially with respect to FIGS. 1, 2 and 3. The opener comprises two operating elements 10 and 12 of elongate generally planar form pivotally connected together intermediate their ends by a pivot pin 14 extending through aligned circular apertures 16 and 18 in said elements and being rivetted over a washer 20. The element 10 mounts a generally cylindrical toothed or serrated traction wheel 22 by means of an axle 24 extending through a circular bushing 26 in an aperture in the element 10 and through an aperture 28 in a cover plate 30 secured to the under surface of the element 10 whereby the wheel 22 is located at the outer surface of the cover plate 30. The axle 24 extends also through a washer 32. The wheel 22 is rotatable by an operating handle 34 keyed to an end of the axle 24 and located on the upper face of the operating element 10. The axis of rotation of the traction wheel 22 is normal to the plane of the adjacent end of the operating element 10 on which the wheel is mounted and as will be appreciated, manual rotation of the operating handle will cause corresponding rotation of the traction wheel. As will be particularly seen from FIG. 3, the traction wheel 22 is of generally cylindrical configuration providing an outer face having a plurality of circumferentially-spaced axially-extending teeth or serrations 23 of substantially equal radius.

The other end of the operating element 10 is shaped to form a handle portion 36.

Figure 5:
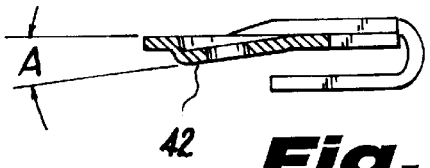
FIG. 5 is a cross-sectional view on the line A—A of FIG. 4.
Figure 6:
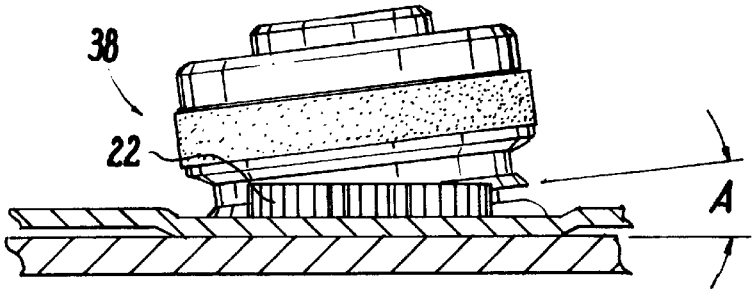
FIG. 6 is an end view of the cutter blade and the operating element on which it is mounted.

The other operating element 12 is also of generally planar configuration and mounts thereon a cutter blade assembly 38 on an axle 40 inclined at an angle A (see FIGS. 5 and 6) of between 5° and 8°, preferably 6°, to the axis of rotation of the wheel 22. The inclination of the axle 40 is provided by an inclined pressed-out portion 42 of the operating element 12 having a circular aperture 44 in which the axle 40 is retained whereby the cutter assembly is freely rotatable relative to the operating element 12.

The other end of the operating element 12 is shaped to form a handle portion 46.

Referring to FIGS. 4 to 8, it will be seen that the cutter blade assembly 38 comprises the said axle 40 rivetted to the inclined portion 42 of the operating element, a circular cutter blade proper 48, a generally cylindrical friction wheel 50 formed of a resiliently deformable material, a lower bearing washer 52 and an upper metal cover plate 54. The diameter of the friction wheel 50 is slightly greater than the diameter of the cutter blade 48. The cutter blade proper 48 is provided at one end of a cylindrical body portion 48*a*, the other end of which comprises a circular flange 48*b* as shown in detail in FIG. 19.

Spaced apart abutments in the form of pressed out shoulders or ridges (not illustrated) may be provided on the outer surface of cover plate 30 whereby in use said abutments are engageable with the axially outer end of a can rim at circumferentially spaced apart positions along the rim.

As will be particularly clearly seen from FIGS. 13 and 14, the operating elements 10 and 12 are pivotable relative to one another between inoperative and operative positions of the traction wheel 22 and cutter blade 48. In FIG. 13, the wheel and the blade are shown in their said inoperative position in which a clearance D1 exists between the nearest points of the wheel 22 and blade 48 sufficient to accommodate the rim of a can to be opened. This inoperative position and clearance D1 are defined by an arcuate slot 56 provided adjacent the end of the operating element 12 on which the cutter blade assembly 38 is mounted. As will be seen, the axle 24 mounting the traction wheel 22 extends through the slot 56 so that its one end 58 provides a stop means against which the axle 40 may abut to define the inoperative position. The operative position shown in FIG. 15 is defined by the other end 60 of the slot 56 against which the axle 40 may abut. In this operative position, a clearance D2 exists between the nearest points of the wheel 22 and blade 48 and this clearance distance is less than the thickness of a rim of a can to be opened.

Referring now to FIGS. 18 and 19 of the drawings, there is shown the can opener with the traction wheel 22 and cutter blade 48 in their operative position in engagement with a can to be opened. As will be seen, in this operative position in use, the wheel 22 is located substantially parallel to an end 62 of a can and spaced therefrom by a distance determined by a cylindrical stop 64 at the outer end of the operating element 10 on which the wheel 22 is mounted for rotation. The outer surface of the wheel 22 engages the radially inner surface of the can rim 66.

The abutments (not illustrated) on the cover plate 30 engage the axially outer end of the can rim 66 thereby to assist in stabilising the can opener relative to the can and to maintain the orientation of the traction wheel and cutter blade relative to the can.

In this in use operative position, the cutter blade 48 penetrates the radially outer surface of the rim 66 but does not cut completely through said rim. The depth of penetration of the cutter blade 48 into the rim 66 is determined by the clearance D2 as described above with reference to FIG. 14. The flange 48*b* and the friction wheel 50 locate below the rim. The radially outer surface of the friction wheel 50 engages the side wall 68 of the can below the rim 66 and is sufficiently deformable to engage the side wall firmly whilst permitting the cutter blade 48 to penetrate at least through one thickness of the metal comprising the rim.

It will be appreciated that when a can is to be opened, the handle portions 36 and 46 of the opener are separated by the user to their maximum extent thereby positioning the traction wheel 22 and cutter blade 48 in their inoperative position with the maximum clearance D1 between their nearest points. The opener is then positioned over a can so that its rim 66 is between the wheel 22 and blade 48 with the flange 48*b* and friction wheel 50 below the rim 66. The handle portions 36 and 46 are then grasped by the user and drawn towards one another thereby bringing the wheel 22 and blade 48 into their operative position wherein the cutter blade 48 penetrates into the radially outer surface of the rim 66. Whilst firmly grasping the handle portions 36 and 46 to retain the wheel 22 and cutter blade 48 in their operative position, the user rotates the operating handle 34 which in turn rotates the wheel 22 causing the can to rotate about its longitudinal axis and also causing the cutter blade 48 to rotate and cut into the rim of the can. This operation is continued for a full revolution of the can about its longitudinal axis and orbit of the cutter blade 48 relative to the rim at which time the handle portions 36 and 46 may be released and the wheel 22 and cutter blade 48 returned to their inoperative position. The can end 62 and a part of the rim 66 may then be removed from the remainder of the rim still attached to the can body.

It will be appreciated that the rim of a can is of standard construction and configuration comprising as shown in cross section in FIGS. 18 and 19 three thicknesses of the metal material which forms the end 62 of the can and two thicknesses of the metal material which forms the side wall 68 of the can. Still referring to FIGS. 18 and 19, it will be seen that penetration of the cutter blade 48 through the radially outer thickness of can end material will sever the rim whereby upon a complete revolution of the can body relative to the opener, the planar part of the can end 62 together with a part of the rim comprising one thickness of material forming part of the can end will be severed from the can body. The remainder of the rim comprising the two thicknesses of side wall material and two thicknesses of can end material will be left attached to the side wall. Thus upon removal of the can end from the can body the upper surface of the can end will be smooth since it comprises the pre-existing turned-over axial end surface of the rim whilst the top end of the side wall of the opened can will also be smooth since it comprises the turned-over metal material which formed part of the rim. An open can can be easily closed by a plastic closure member fitted over the smooth end of the can body thereby to preserve the contents of the can.

During opening of the can a force is imparted tending to move the can towards the opener by virtue of the inclination of the cutter blade 48 relative to the wheel 22.

Upon severance of the can end from the can body, the can will remain engaged with the can opener and will not fall off due to the engagement of the friction wheel 50 below the can rim 66, see FIG. 3. Furthermore, since the cutter blade does not penetrate completely through the can rim, there is no possibility of metal cuttings or any other contaminant entering the can during opening.

As mentioned earlier, it is possible that the severed can end does not always separate readily from the remainder of the rim attached to the can body due to variations in metal thickness, rim size and the presence of gum or other sealants in the rim. In order to assist complete separation of the can end from the can body there is provided a gripper mechanism comprising two opposed jaws 70 and 72 movable towards and away from one another whereby the user of the can opener can exert a firm grip on that part of the rim attached to the can end after severance in order to remove it completely from the can body. Referring particularly to FIGS. 15–17, the opposed gripper jaws of the gripper mechanism comprise a first jaw 70 fixedly secured such as by a rivet 74 to the operating element 10 which mounts the traction wheel 22. The other jaw 72 comprises an integral lateral extension of the operating element 12 which mounts the cutter blade 48. The opposed surfaces of the two jaws 70 and 72 are serrated in order to enhance their gripping capability. As shown in FIG. 15, the two jaws are separated from one another when the operating elements 10 and 12 are pivoted to their maximum separation i.e. to the inoperative position. In FIG. 16 the operating elements have been pivoted relative to one another towards the operative position hence moving the opposed faces of the gripper jaws towards one another. In FIG. 17, i.e. the operative position, the opposed gripper jaws are shown engaged with that part of the rim attached to the end of the can whereby it may be readily removed from the remainder of the rim attached to the can body. Sufficient gripping force on the can rim can be exerted by the user as may be necessary to hold and completely detach the can end. After separation, the user can merely position the can end over a suitable waste receptacle and move the operating elements towards their inoperative position thereby opening the gripper jaws and releasing the can end. There is thus no possibility of a part of the can end and its rim becoming jammed onto the can opener as is possible with the types of resiliently biased claw mechanisms described in the prior art.

As shown in the drawings, the can opener also includes a bottle opener portion 76 and a blade portion 78 which can be used as a wedge to facilitate separation of, for example, a lid from a box.

A can opener constructed in accordance with the invention exhibits various advantages when compared with can openers described in the prior art. For example, in International patent publication no. WO 85/03280 the rotational axis of the cutter blade is not inclined to the rotational axis of the traction wheel and the actual cut is produced at approximately the axial mid-point of the rim. During cutting of the rim, there will be little force exerted axially against either edge of the cut rim due to the parallelism of the said two axes. Conversely, the axis of rotation of the cutter blade in the present invention is inclined at an angle of between 5° and 8°, preferably substantially 6°, to the axis of rotation of the traction wheel whereby during cutting of the rim, an axial force will be applied to the opposed cut edges thereby tending to separate them and enhance severance of the can end from the can body. Furthermore, the inclined axis of the cutter blade ensures that the cut into the rim is made at a position approximately ⅓ of the depth of the rim from its top.

The cutting position at approximately ⅓ of the depth of the rim from its top is important. If the cut is made lower e.g. around the axial mid-point of the rim, it will be difficult to separate the can end from the can body even if the outer thickness of rim metal is penetrated completely during cutting. The potential problem will be realised by reference to the enlarged detail of FIG. 19; if the cut is at the axial mid-point of the rim, the can body thicknesses of metal may remain quite firmly sandwiched or clamped between the innermost and outermost thicknesses of can end metal. Thus even if the outer thickness of can end metal is completely penetrated during cutting, it could still be difficult to release the can end and its attached rim part from the remaining rim part attached to the can body.

If the cut is made too close to the top of the rim, it may be impossible to sever the outer thickness of metal. Referring again to FIG. 19 it will be seen that such a cut would be directed more into the plane of the metal at the top of the rim rather than through the thickness of the metal.

The optimum position of cut is below the top of the rim, around ⅓ of the rim depth from its top, whereby as will be seen in FIG. 19, the cut outer thickness of can end metal tends to spring away from the adjacent thickness of can body metal thereby facilitating separation of the rim parts from one another.

The number of teeth or serrations on the generally cylindrical traction wheel are reduced compared with prior art proposals. Such reduced teeth density combined with the provision of a freely rotatable cutter blade ensures that the force needed to operate the can opener is minimised and that no metal shavings are formed on the radially inner face of the severed rim.

The can opener of the invention also provides a degree of deflection of the cutter blade axis. There is always a small amount of play present at the pivot pin 14 whereby the operating elements are deflectable to a limited extent away from one another in a plane parallel to the pivot axis. The amount of deflection is limited by the cover plate 30 but is sufficient to enable the pivot axis of the cutter blade to be deflected to a small extent from its normal inclination of substantially 6° to the axis of rotation of the traction wheel. This deflection enhances the ability of the traction wheel to maintain the cut at a position approximately ⅓ of the depth of the rim from its top.

It has also been mentioned earlier that the friction wheel has a diameter which is slightly greater than that of the cutter blade. The friction wheel is formed of a resiliently deformable material and presses against the can wall below the rim during the cutting operation to locate the cutter blade at its optimum position for cutting. Variations in rim thickness can therefore be accomodated whilst still positioning the cutter blade for an optimum depth of cut into the rim.

What is claimed is:

1. A can opener comprising a pair of operating elements pivotal with respect to one another, one said element mounting a rotatable traction wheel and the other said element mounting a rotatable circular cutting blade, said wheel and said blade being moveable between an inoperative position in which said wheel and said blade are spaced from one another to an extent that the rim of the can to be opened is locatable between said wheel and said blade, and an operative position in which said wheel and said blade are in close proximity and engageable with the can to effect opening thereof, characterized in that the traction wheel is of generally cylindrical configuration and has an axis of rotation which in use is substantially parallel to the longitudinal axis of a can to be opened, said cutter blade comprising an assembly including said cutter blade and a circular friction wheel rotatable about the same axis of rotation as said cutter blade, said friction wheel being located axially outwardly of said cutter blade relative to the operating element on which they are mounted and being of such a diameter that, in use in said operative position, said friction wheel is engageable with the sidewall of a can to be opened below the rim thereof, said cutter blade having an axis of rotation inclined to the axis of rotation of the traction wheel, said wheel and said blade in said operative position being in opposed non-overlapping relationship with one another and spaced apart at their nearest points by a distance less than the thickness of the rim of a can to be opened whereby, in use in said operative position, said wheel is engageable with the radially inner surface of a can rim in substantially parallel relationship with an end of the can, and said blade is engageable with the radially outer surface of a can rim to penetrate said rim partially but not completely, rotation of said traction wheel effecting cutting of said rim by said blade, the penetration of the cut being sufficient to sever an end from the can.

2. A can opener as claimed in claim 1 wherein the one operating element which mounts said traction wheel comprises a planar face and the axis of rotation of said wheel is perpendicular to said face, and the other operating element which mounts said cutter blade comprises a planar face parallel to the planar face of the other operating element whereby, in use in said operative position, said planar faces are parallel or substantially parallel to an end of a can to be opened.

3. A can opener as claimed in claim 1 wherein said traction wheel is mounted for rotation on an axle member and is driveable for rotation by a drive member mounted on said axle.

4. A can opener as claimed in claim 3 wherein said drive member comprises a manually operable handle.

5. A can opener as claimed in claim 1 wherein said cutter blade is mounted on an axle member and is freely rotatable relative to its associated operating element.

6. A can opener as claimed in claim 1 wherein said cutter blade is part of an assembly comprising the said cutter blade and a circular friction wheel rotatable about the same axis of rotation as the cutter blade, said friction wheel being located axially outwardly of said cutter blade relative to the operating element on which they are mounted and being of such a diameter that, in use in said operative position, said friction wheel is engageable with the side wall of a can to be opened below the rim thereof.

7. A can opener as claimed in claim 1 wherein said friction wheel comprises a resiliently deformable material.

8. A can opener as claimed in claim 1 wherein said operating elements are of elongate configuration pivotally connected together and providing handle portions at adjacent ends of said elements for grasping by a user, respective other ends of said elements mounting said traction wheel and said cutter blade.

9. A can opener as claimed in claim 8 wherein said operating elements include stop means limiting their relative pivotal movement between said inoperative and operative positions of said traction wheel and cutter blade.

10. A can opener as claimed in claim 8 wherein said traction wheel and said cutter blade are mounted on said operating elements at respective opposite ends thereof to said handle portions, and said operating elements are pivotally connected together intermediate their ends.

11. A can opener as claimed in claim 1, wherein the outer surface of the traction wheel is serrated.

12. A can opener as in claim 1, including a device for assisting removal of the can end and that part of the rim attached thereto from the remainder of the rim attached to the can body after cutting of the rim;

said device comprising a first gripper member mounted on one of said operating elements and a second cooperating gripper member mounted on the other said operating element, the gripper members being moveable towards and away from one another upon pivotal movement of the operating elements relative to one another, whereby the gripper members may be brought towards one another by the user to grip that part of the rim attached to the can end thereby to enable the user to remove the can end and its attached said part of the rim from the remainder of the rim attached to the can body and whereby the gripper members may be moved away from one another by the user to release said part of the rim.

13. A can opener as claimed in claim 12 wherein one said gripper member comprises a gripper jaw fixedly secured to one of the operating elements and the other said gripper member comprises a gripper jaw integral with a other operating element.

14. A can opener as claimed in claim 13 wherein the one said gripper jaw is fixedly secured to that operating element which mounts the traction wheel and the other said gripper jaw is integral with that operating element which mounts the cutter blade.

15. A can opener as claimed in claim 12 wherein the said gripper members are separated from one another in the said inoperative position and are moveable towards one another as the operating elements are moved towards said operative position.

16. A can opener as claimed in claim 12 wherein each said gripper member comprises a serrated gripper face, the two said faces being opposed to one another, thereby to enhance the grip of the gripper members, in use, on a said part of the rim.

17. A can opener as claimed in claim 16 wherein the opposed gripper faces of the gripper members are disposed substantially parallel to one another in the said operative position.

18. A can opener as in claim 1, in which said angle of inclination is substantially 6°.

* * * * *